US005168133A

United States Patent [19]

Bahjat et al.

[11] Patent Number: 5,168,133

[45] Date of Patent: Dec. 1, 1992

[54] AUTOMATED SELECTION OF HIGH TRAFFIC INTENSITY ALGORITHMS FOR UP-PEAK PERIOD

[75] Inventors: Zuhair S. Bahjat, Farmington; Joseph Bittar, Avon, both of Conn.

[73] Assignee: Otis Elevator Company, Farmington, Conn.

[21] Appl. No.: 779,433

[22] Filed: Oct. 17, 1991

[51] Int. Cl.[5] ..... B66B 1/20

[52] U.S. Cl. ..... 187/125; 187/127

[58] Field of Search ..... 187/124, 127, 103

[56] References Cited

U.S. PATENT DOCUMENTS 4,760,896 8/1988 Yamaguchi ..... 187/124

4,947,965 8/1990 Kuzunuki et al. ..... 187/127

*Primary Examiner*—A. D. Pellinen

*Assistant Examiner*—Lawrence E. Colbert

*Attorney, Agent, or Firm*—Breffni X. Baggot

[57] ABSTRACT

During up-peak, a dispatcher selecting method chooses among three dispatching algorithms: (i) an up-peak sectoring scheme triggered when two cars leave the lobby fully loaded, (ii) static sectoring, and (iii) dynamic sectoring, in response to any of three criteria: car load, floor population, and average waiting time, allowing a group of elevators to be operated under any three of the dispatching algorithms, not locked into any two.

3 Claims, 10 Drawing Sheets

AUTOMATED SELECTION OF HIGH TRAFFIC INTENSITY ALGORITHMS FOR UP-PEAK PERIOD

REFERENCE TO RELATED APPLICATIONS

Reference is made to co-pending applications "Elevator Dynamic Channeling Dispatching for Up-peak Period", Ser. No. 07/508,312; "Elevator Dynamic Channeling Dispatching Optimized Based on Car Capacity", Ser. No. 07/508,313; "Elevator Dynamic Channeling Dispatching Optimized Based on Population Density of the Channel", Ser. No. 07/508,318; and "Floor Population Detection for an Elevator System", Ser. No. 07/580,887; all four applications being by the inventor, N. Kameli.

1. Technical Field

This invention relates to elevator dispatching. The invention collects information on traffic flow and uses it in choosing a dispatching algorithm.

2. Background Art

Many elevator dispatching systems are inefficient because:

(i) the queue length, i.e. the number of people waiting to be served by the elevator, is unnecessarily long, (ii) the waiting time of passengers is unnecessarily long, and (iii) the number of stops by the car is more than it needs to be to achieve the same level of service.

The goal of an improved dispatching system is to reduce the time required for elevator service, or simply, the service time. The service time is composed of waiting time and travel time. The waiting time is the time period from when a passenger presses a button to make a hall call to the time when the elevator arrives to receive the passenger. The travel time is the time period from arrival of the elevator to receive the passenger to the arrival of the elevator at the destination floor and is dependent upon car speed and the number of car stops. Improved dispatching, while it cannot increase car speed, can both improve waiting time and reduce the number of car stops to reduce the time required for elevator service.

In order to maximize the efficiency of a dispatching system, the elevator should be dispatched when the number of people wishing to go to a particular floor is maximized—this would minimize the percentage of time that the car is not full on a run. An improved dispatching system will also take into account the extent that the traffic flow in a given building follows certain general patterns during certain periods of the day. Traffic from the lobby to the upper floors of an office building, called up-peak, is high in the early morning when people are coming to work. Traffic from the upper floors of the building to the lobby, called down-peak, is highest in the late afternoon, when people are leaving work. Interfloor traffic, traffic usually found between the hours of 10:00 a.m. and 12:00 p.m. or 1:00 and 4:00 p.m., when people have come to work and are working on a particular floor, but are not going to or from lunch, is less pronounced than up-peak or down-peak, and may be appropriately called off-peak. Several prior art dispatching systems are available.

UP-PEAK

During dispatching, according to an up-peak routine, the elevator system dispatches the cars in round-robin fashion in response to an up-peak condition in further response to an up-peak clock and a signal that two cars have left the lobby partially loaded within a predetermined interval. The up-peak clock is turned on at the beginning of the day at a time selected by a building owner, for example, 8:00 a.m., and triggered off at a later time, for example, 10 a.m.

STATIC SECTORING

An advance in dispatching over the up-peak routine divides the building, while the up-peak clock is on, into sectors of contiguous floors for elevator service so that certain floors are grouped in a specific sector and selected elevator cars are assigned to service that sector so that the number of car stops is minimized and round-trip time reduced. A system of dividing the building into sectors may be found in U.S. Pat.No. 4,804,069 by Bittar et al entitled "Contiguous Floor Channeling Elevator Dispatching." This patent discloses a system of "static sectoring" in which the total number of floors in a building is divided into a constant number of sectors equal to the number of cars which are in operation minus x(where x is 1, 2, 3, etc.) and not assigned to the lobby. This dispatching method is executed following execution of the up-peak routine.

Static sectoring is not the optimum dispatching strategy because it does not consider variations in traffic patterns.

DYNAMIC SECTORING

A system of sectoring may be found in U.S. Pat. No. 4,846,311 by Thangavelu, entitled "Optimized Up-Peak Elevator Channeling System With Predicted Traffic-Volume Equalized Sector Assignments." In this patent, the number of floors per sector is variable. The number of floors in each sector is varied based (a) upon the location of the passengers in the building and (b) their pattern of movement within the building, and not upon the number of floors in a building. U.S. Pat. No. 4,846,311 discloses an elevator dispatching system using sectoring to decrease queue length and waiting time and increase elevator handling capacity. This system of sectoring assigns floors to sectors such that the traffic volume per sector is equal. This method is different from static sectoring in which a) the number of floors per sector is constant regardless of the number of people in the sectors, and b) the assignment of the floors to the sectors does not change as long as the number of cars in service does not change. This system uses real and historic time predictions of traffic to determine the assignment of floors to sectors.

Sectoring, as disclosed in these patents, has been effective, but may be further improved. While the number of floors in a sector is not constant in U.S. Pat. No. 4,486,311, the number of sectors in the building is constant. Secondly, U.S. Pat. No. 4,846,311 does not teach constraining the number of floors in a sector with the result that there might be, for example, ten floors in a single sector allowing the potential for less than optimum dispatching. Thirdly, the above system of sectoring allows one sector to overlap another. Passengers planning to go to the overlapped floor may see that they can get there quicker by boarding the car with the overlapped floor as its first stop rather than its last. This will cause a reduction in the overall efficiency of the dispatching strategy.

In co-pending application "Elevator Dynamic Channeling Dispatching for Up-peak Period", Ser. No. 07/508,312, a dynamic sectoring dispatching system is provided so that floors of a building are assigned to nonoverlapping, equal traffic volume sectors that are dynamic in that both the number of floors in the sectors and the number of sectors is variable, depending upon traffic predictions for an up-peak period in the building. The floors within a sector are contiguous and the sectors within the building are contiguous. After the sectors are created a car is assigned to each sector to be dispatched in association therewith. A floor service indicator means displays which cars have been assigned to which sectors. This dynamic sectoring works from the fact that the dispatching methodology used before implementation of the present methodology was static sectoring used during the up-peak period. When a traffic volume exceeds a certain limit, the reference switches from static sectoring to dynamic channeling.

Dynamic sectoring may be based on car capacity. In "Elevator Dynamic Channeling Dispatching Optimized Based on Car Capacity", Ser. No. 07/508,313, where: (i) an elevator system dispatches cars by assigning them to contiguous sectors, (ii) the sectors consist of contiguous floors, and (iii) the sum of the populations of adjacent sectors falls below 100% of car capacity, those sectors are combined.

Dynamic sectoring may also be based on the population of the sector ("Elevator Dynamic channeling Dispatching Optimized Based on Population Density of the Channel", Ser. No. 07/508,318). An improvement is made on an elevator dispatching system that assigns floors of a building to sectors created depending upon traffic for an up-peak period. When the sum of the populations of adjacent sectors does not exceed a given limit, the adjacent sectors are combined and the elevator cars are dispatched according to the new sector assignments.

It is noted that some of the general prediction techniques utilized in the present invention are discussed in general (but not in any elevator context or in any context analogous thereto) in *Forecasting Methods & Applications* by Spiros Maridakis and Steven C. Wheelwright (John Wiley & Sons, Inc., 1978).

DISCLOSURE OF THE INVENTION

Objects of the present invention include efficiently dispatching elevator cars to decrease passenger waiting time, to decrease passenger queue lengths, and to decrease elevator service time during the up-peak period.

According to the present invention, during up-peak, a dispatcher selecting method chooses among three dispatching algorithms: (i) an up-peak scheme triggered when two cars leave the lobby fully loaded, (ii) static sectoring, and (iii) dynamic sectoring, in response to any of three criteria: car load, floor population, and average waiting time, allowing a group of elevators to be operated under any three of the dispatching algorithms, not locked into any two.

These and other objects, features and advantages of the present invention will become more apparent in light of the following detailed description of a best mode embodiment thereof, as illustrated in the accompanying drawing.

BEST MODE FOR CARRYING OUT THE INVENTION

Figure 1:
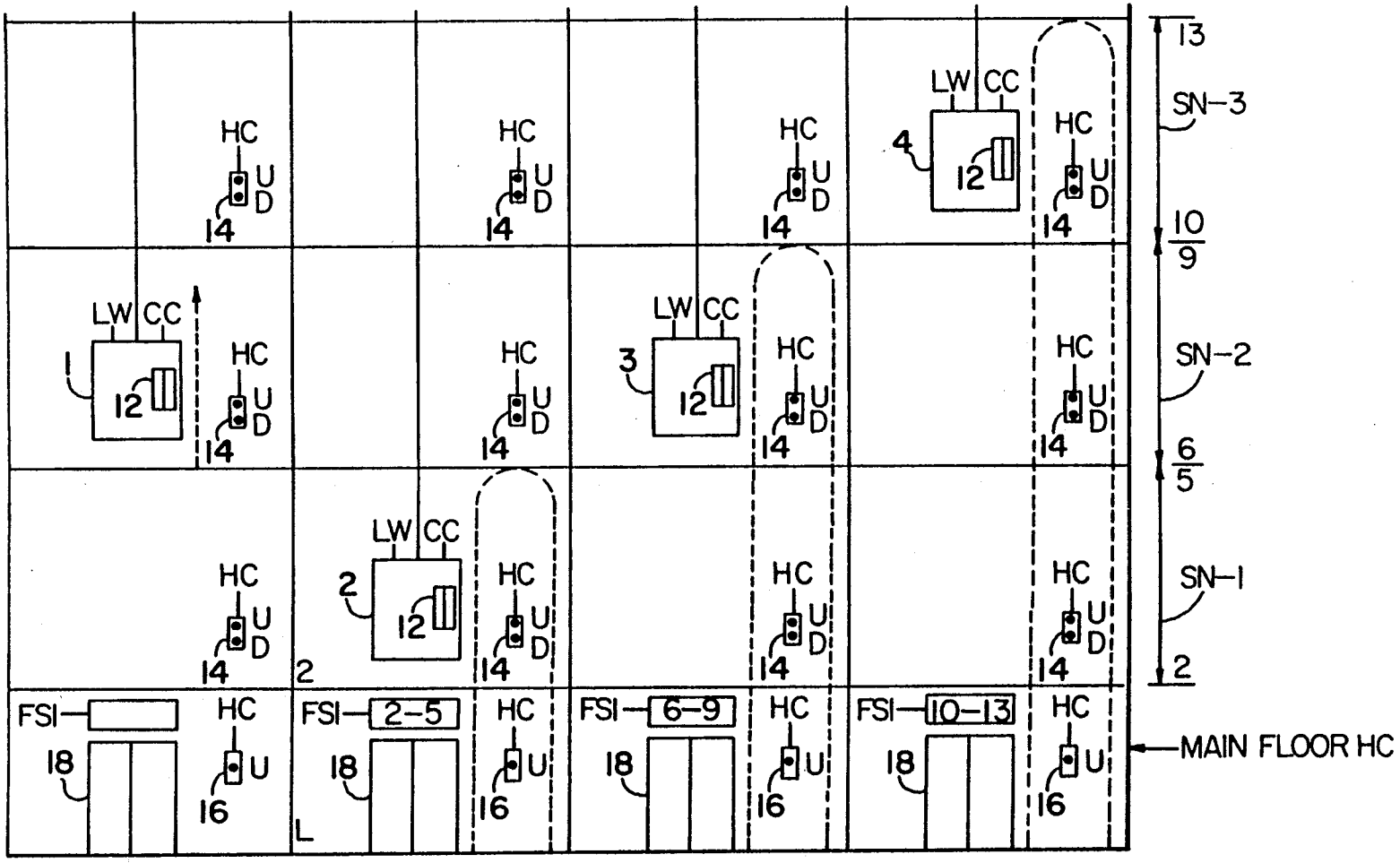
FIG. 1 is a plan view of an elevator system in which the present invention may be applied.

An exemplary multi-car, multi-floor elevator application, with which the exemplary system of the present invention can be used, is illustrated in FIG. 1. Elevator cars 1–4 serve a building having a plurality of floors. The building has an exemplary 13 floors above a main floor, typically a ground floor or lobby (L). However, some buildings have their main floor at some intermediate or other portion of the building, and the invention can be adapted to them as well. Each car 1–4 contains a car operating panel (COP) 12 through which a passenger may make a car call to indicate a destination floor by pressing a button on the COP, producing a signal (CC), identifying the floor to which the passenger intends to travel. On each of the floors there is a hall fixture 14 through which a hall call (HC) is provided to indicate the intended direction of travel by a passenger on the floor. At the lobby (L), there is also a hall call fixture 16, through which a passenger calls the car to the lobby.

The depiction of the elevator system in FIG. 1 is intended to illustrate the selection of cars during an up-peak period, according to the invention, at which time the floors 2—13 above the main floor or lobby (L) are divided into an appropriate number of sectors depending upon the number of cars in operation and the traffic volume, with each sector containing a number of contiguous floors assigned in accordance with the criteria and operation used in the present invention.

The number of sectors into which the building is divided may change based on variations in the values of system traffic parameters and hence the building traffic. These traffic parameters may be car load weight (LW), or hall calls (HC) or car calls (CC). The number of sectors into which the building is divided will be greater than or equal to 1, not a constant. The number of sectors is assigned such that each sector carries a volume of traffic approximately equal to that of any other sector. At the lobby, there is a floor service indicator (FSI) for each car which shows the temporary, current selection of available floors exclusively reachable from the lobby by the car assigned to that sector, which assignment changes throughout the up-peak period. For distinguishing purposes each sector is given a sector number (SN) and each car is given a car number (CN).

The assignment of floors to sectors shown in FIG. 1 represents only the sectors being used at a particular instant in time. The assignment of floors to the sectors shown, and consequently the division of the floors of the building into sectors, is dynamic, based on traffic variations. As empty cars arrive at the lobby, they are assigned to sectors in "round robin" fashion. Each receives a sector assignment as it arrives at the lobby. If, for example, car 4 has just left the lobby and cannot be given a new sector assignment car, one will receive the assignment as soon as it gets to the lobby.

FIG. 1 shows an exemplary floor-car-sector assignment. Car 1 is allowed to be unassigned to a sector; car 2 (CN=2), is assigned to serve the first sector (SN=1). Car 3 (CN=3) serves the second sector (SN=2), and car 4 (CN=4) serves the third sector (SN=3). As Car 1 is not assigned to a sector it may serve none of the floors. The floor service indicator (FSI) for car 2 will display, for example, floors 2–5, the presumed floors assigned to the first sector for this example, to which floors that car will exclusively provide service from the lobby. Car 3 similarly provides service to a second sector, consisting of the floors assigned to that sector, for example floors 5–9, and the FSI for car 4 will show those floors. The FSI for car 4 indicates floors 10–13, the floors assigned to a third sector. Because of the round-robin assignment of cars to sectors, Car 1, though not functioned at the instant shown, will be assigned the next available sector in the order.

The FSI for car 1 is not illuminated, showing that it is not serving any particular sector at this particular instant of time during the up-peak sectoring sequence reflected in FIG. 1.

Each car will only respond to car calls that are made in the car from the lobby to floors that coincide with the floors in the sector assigned to that car. Car 4, for instance, will only respond to car calls made at the lobby to floors 10–13. It will take passengers from the lobby to those floors (provided car calls are made to those floors) and then return to the lobby empty, unless it is assigned to a hall call.

This system can collect data on demand throughout the day, by means of car call and hall call activations, for example, to arrive at a historical record of traffic demands for each day of the week and compare it to actual demand to adjust the overall dispatching sequences.

Figure 2:
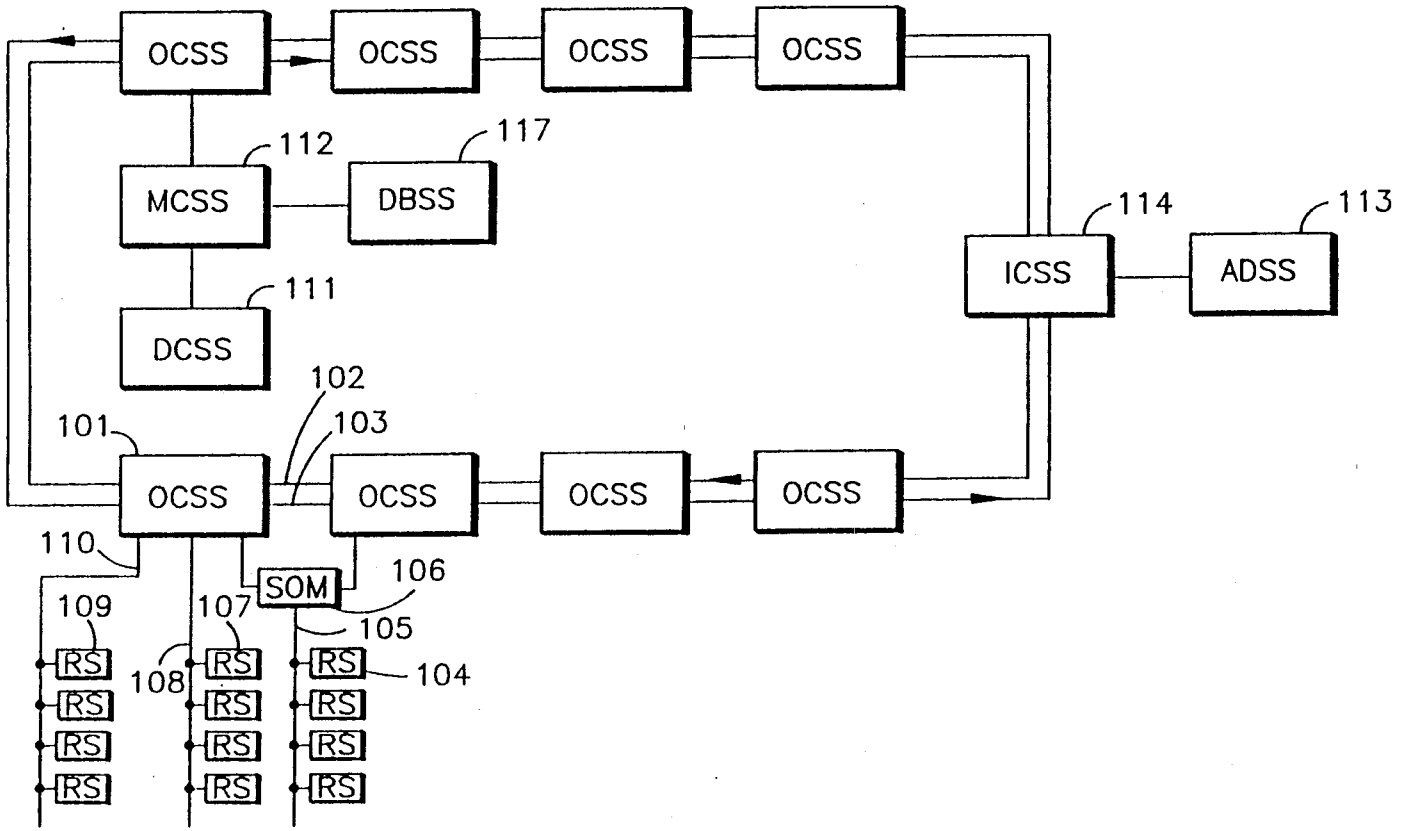
fig. 2 prior art
FIG. 2 is a block diagram of a elevator control system using ring communication.

Signals HC and CC are read by an OCSS 101 associated with the car and then communicated to all OCSSs 101 via a ring communication system (FIG. 2) for computation of the relative system response. As described in "Relative System Response Call Assignments", U.S. Pat. No. 4,323,142 to Bittar, incorporated herein by reference, load weight (LW) is read by a motion control subsystem (MCSS) 112, the maximum and minimum values during a time interval are taken and converted to an average load weight and communicated to an ADSS 113 via the OCSSs 101 and the ring communication system for conversion to boarding and deboarding counts. Given this traffic data, predictions are made and communicated by means of a ring communication system (FIG. 2). There are four microprocessor systems associated with every elevator. FIG. 2 shows an eight car group, each car having one operational controller subsystem (OCSS) 101, one door control subsystem (DCSS) 111 and one motion control subsystem (MCSS) 112 and a drive brake subsystem 117. Such a system may be found in co-pending application Ser. No. 07/029,495, entitled "Two-Way Ring Communication System for Elevator Group Control" by Auer and Jürgen (filed Mar. 23, 1987).

There, the task of elevator dispatching may be distributed to separate microprocessor systems, one per car. These microprocessor systems, known as operational control subsystems (OCSS) 101, are all connected together via two serial links (102, 103) in a two way ring communication system. FIG. 2 shows an eight car group configuration. For clarity purposes MCSS (112) and DCSS (111) are only shown in relation to a specific OCSS 101; however, it is to be understood that there would be eight sets of these systems, one set to correspond with each elevator.

Hall buttons and lights, i.e., the elevator group related fixtures as opposed to car related fixtures, are connected with remote stations 104 and remote serial communication links 105 to the OCSS 101 via a switchover module (SOM) 106. The car buttons, lights and switches are connected through remote stations 107 and serial links 108 to the OCSS 101. Car specific hall features, such as car direction and position indicators, are connected through remote stations 109 and a remote serial link 110 to the OCSS 101.

The car load measurement is periodically read by a DCSS 111. This load is sent to MCSS 112. DCSS 111 and MCSS 112 are microprocessor systems controlling door operation and car motion under the control of the OCSS 101.

The dispatching function is executed by the OCSS 101, in conjunction with an advanced dispatcher subsystem (ADSS) 113, which communicates with the OCSS 101 via an information control subsystem (ICSS) 114. The ICSS acts as a communication interface between the elements connected to the ring (OCSSs) and the ADSS 113. The measured car load is converted into boarding and deboarding passenger counts by MCSS 112 and sent to OCSS 101. Each OCSS 101 sends this data to the ADSS 113 via ICSS 114.

The ADSS 113, through signal processing, collects the passenger boarding and deboarding traffic data and car departure and arrival data at the lobby, so that, in accordance with its programming, it can predict traffic conditions at the lobby for predicting the start and end of peak periods, for example up-peak and down-peak. The ADSS 113 determines passenger boarding and deboarding counts at other floors and car arrival and departure counts for use in up-peak sectoring and for varying penalties based on predicted traffic. For further information on these techniques see U.S. Pat. No. 4,363,381, "Relative System Response Call Assignments", U.S. Pat. No. 4,323,142, "Dynamically Reevaluated Elevator Call Assignments", both to Bittar, and a magazine article entitled "Intelligent Elevator Dispatching System", by Nader Kameli and Kandasamy Thangavelu (*AI Expert*, Sep. 1989; pp. 32–37). These disclosures are incorporated herein by reference.

The system can collect data on individual and group demands throughout the day to arrive at a historical record of traffic demands for each day of the week and compare it to real-time demand to adjust the overall dispatching sequences to achieve a prescribed level of elevator system performance. Further, historical and real-time traffic data are used to make traffic predictions based upon these data. Following such an approach, car load, percentage of car capacity filled (car load divided by car capacity), average waiting time, and lobby traffic may be determined through signals (LW), from each car, that indicate car load for each car.

Figure 3A:
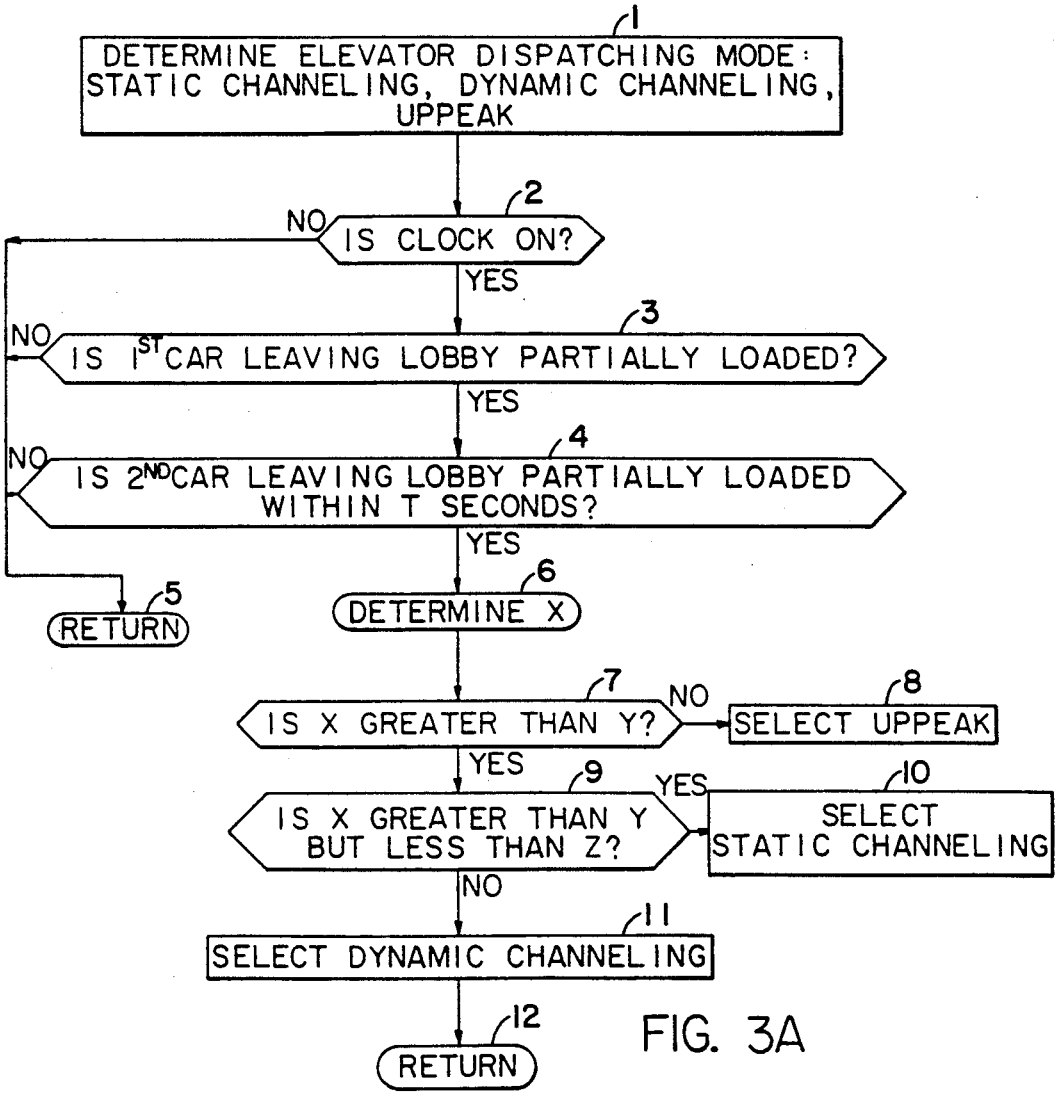
FIGS. 3A, 3B, 3C are logic flow diagrams for implementing the present invention.

Shown in FIG. 3A, the present invention is concerned with the selection of dispatching algorithms for up-peak time period. In step 1, it is determined which dispatching mode the elevators are being dispatched under: up-peak, static sectoring, or dynamic sectoring. In steps 2–4, it is determined whether the system is on up-peak. If not, the algorithm of the present invention is not executed, step 5. If the elevator system is on up-peak, steps 2–4 affirmative, and car load X is determined in step 6, is less than a given value Y, step 7 affirmative, then the up-peak algorithm is selected, step 8. If the car load X is greater than Y, but less than Z, step 9 affirmative, then the static sectoring algorithm is selected, step 10. If the car load is greater than Z, step 9 negative, then the dynamic sectoring algorithm is selected, step 11.

Figure 3B:
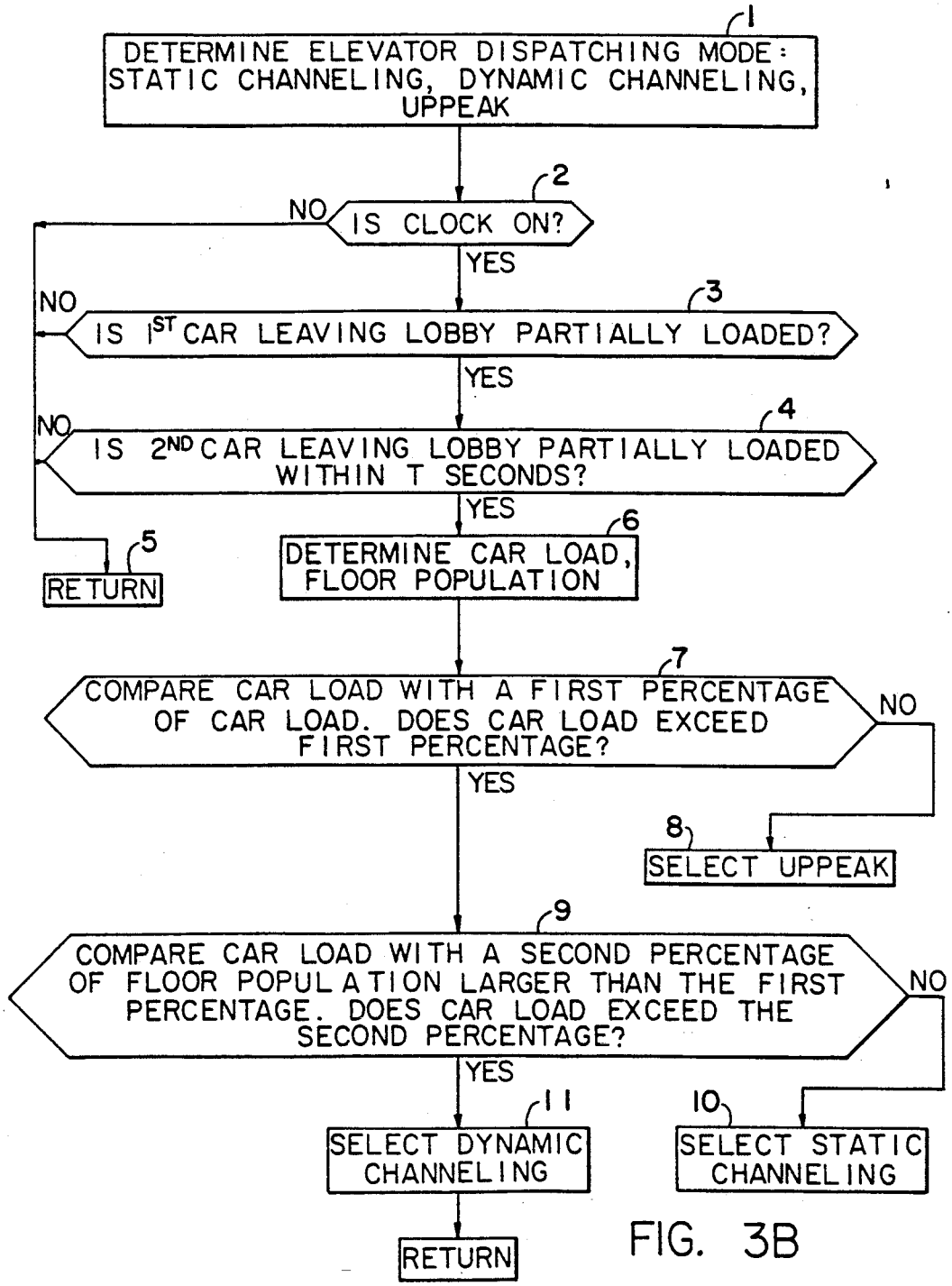

In FIG. 3B, in a second embodiment, if the elevator is on up-peak, steps 2–4, the number of people inside the car and the floor population are detected, step 6. A method of determining floor population is disclosed in allowed application Ser. No.07/580,887, "Floor Population Detection for an Elevator System", which is incorporated herein by reference. If, the number of people inside the car is between zero and a first percentage of the floor population, step 7 negative, then the up-peak algorithm is run, step 8. The first percentage is, for example, 10%. If, however, the number of people inside the car is greater than 10%, step 7 affirmative, but less than a second exemplary percentage of 14%, step 9 negative, then the static sectoring algorithm is selected, step 10. If the number of people inside the car is greater than, for example, 14% of the floor population, step 9 affirmative, then the dynamic sectoring algorithm is selected, step 11. If the system is not on up-peak, step steps 2–4 negative, the methodology of the present invention is not executed.

Figure 3C:
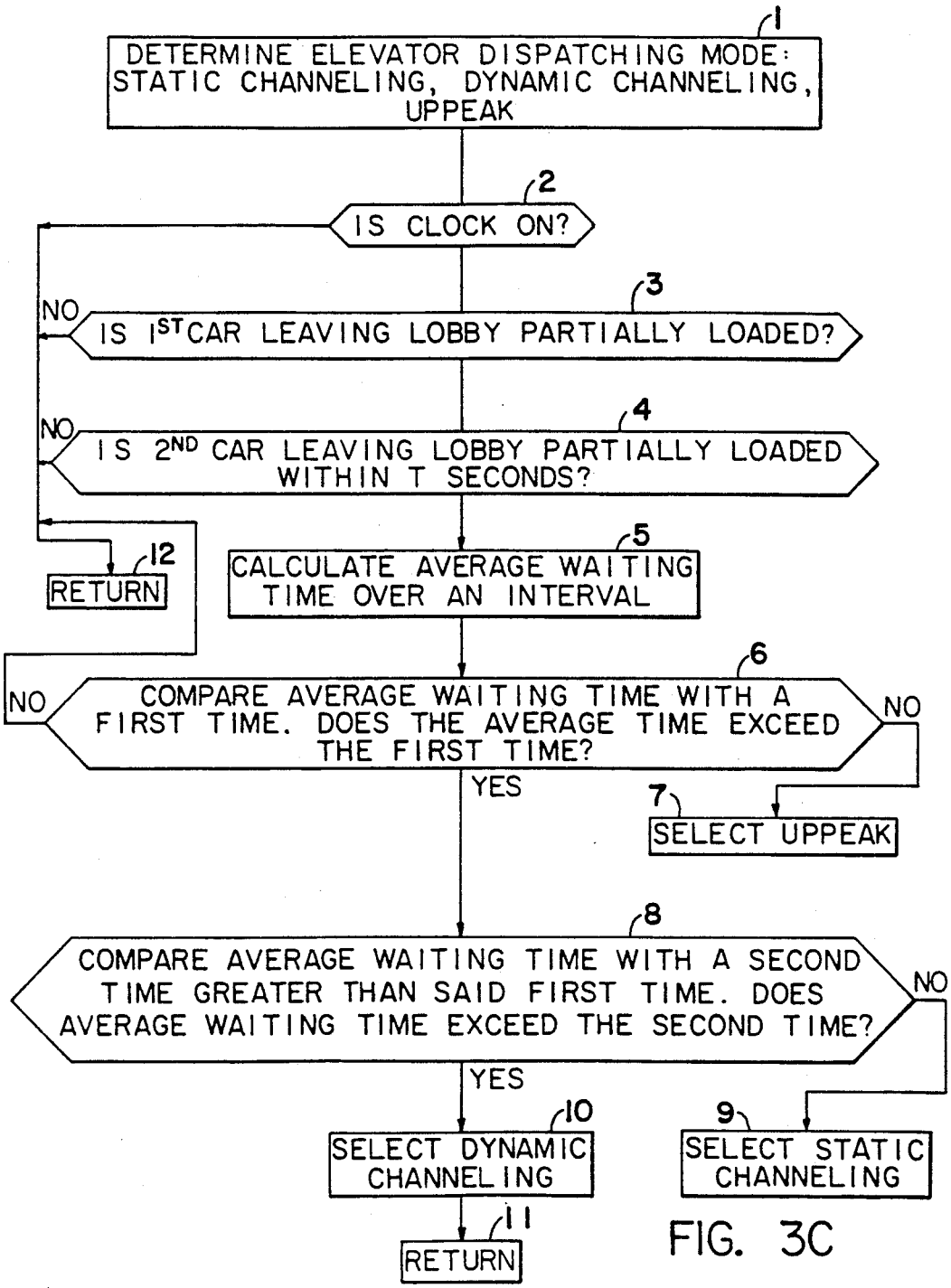

In FIG. 3C, in a third embodiment, if the elevator system is on up-peak, steps 2–4 affirmative, the average waiting time over a five-minute interval is calculated, step 5. If the average waiting time over the last five minutes is below a first time of, for example, 30 seconds, step 6 negative, then the up-peak algorithm is selected, step 7. If the last five minutes average waiting time is greater than, for example, 30 seconds, step 6 affirmative, but less than a second time of, for example, 45 seconds, step 8 negative, then the static sectoring method is selected. If the last five minutes average waiting time is greater than, for example, 45 seconds, step 8 affirmative, then the dynamic sectoring algorithm is selected, step 10. If the elevator system is not on up-peak, steps 2–4 negative, then the algorithm of the present invention is not executed, step 12.

Figure 4:
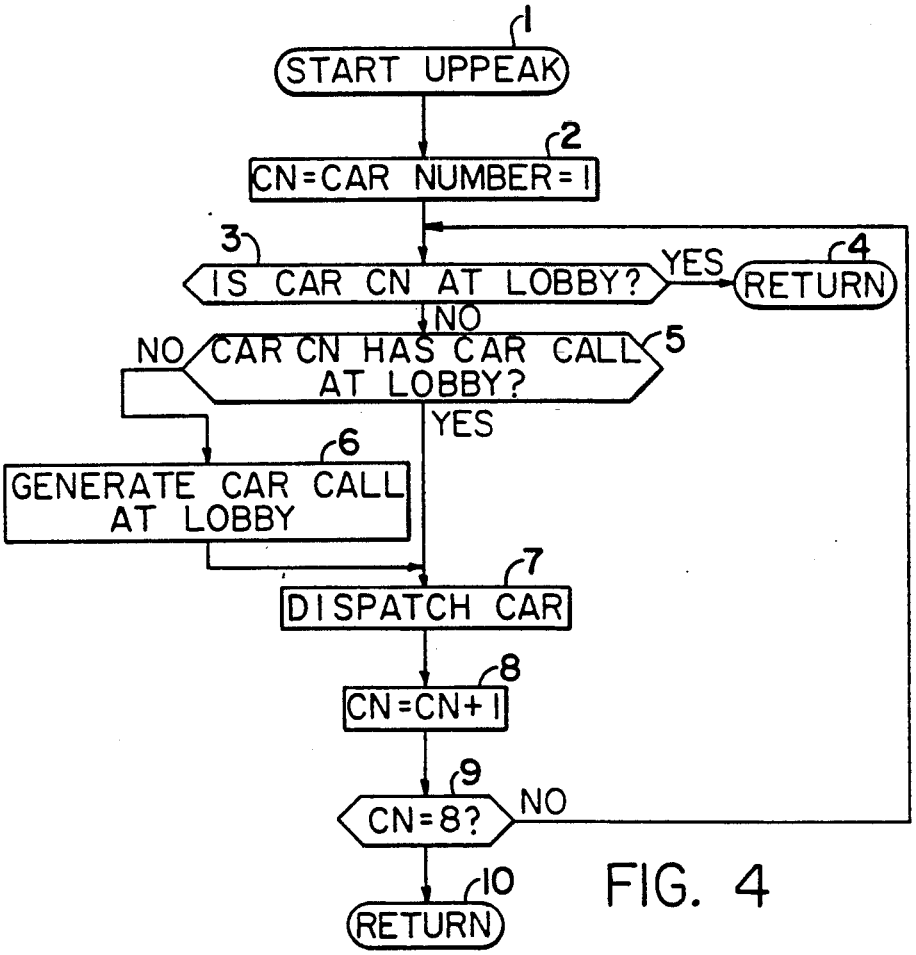
FIG. 4 is a logic diagram for implementing an up-peak routine.

In FIG. 4, the up-peak method is started at step 1 and assigns a car number CN to the first car to be considered, step 2. Cars are dispatched to all floors from the lobby, step 7. Cars that are not at the lobby are forced to the lobby, step 6. In this way, cars are dispatched during up-peak from the lobby in round-robin fashion. Thus, the up-peak routine is conditioned on the turning on of the up-peak clock and two cars leaving the lobby partially loaded.

Figure 5A:
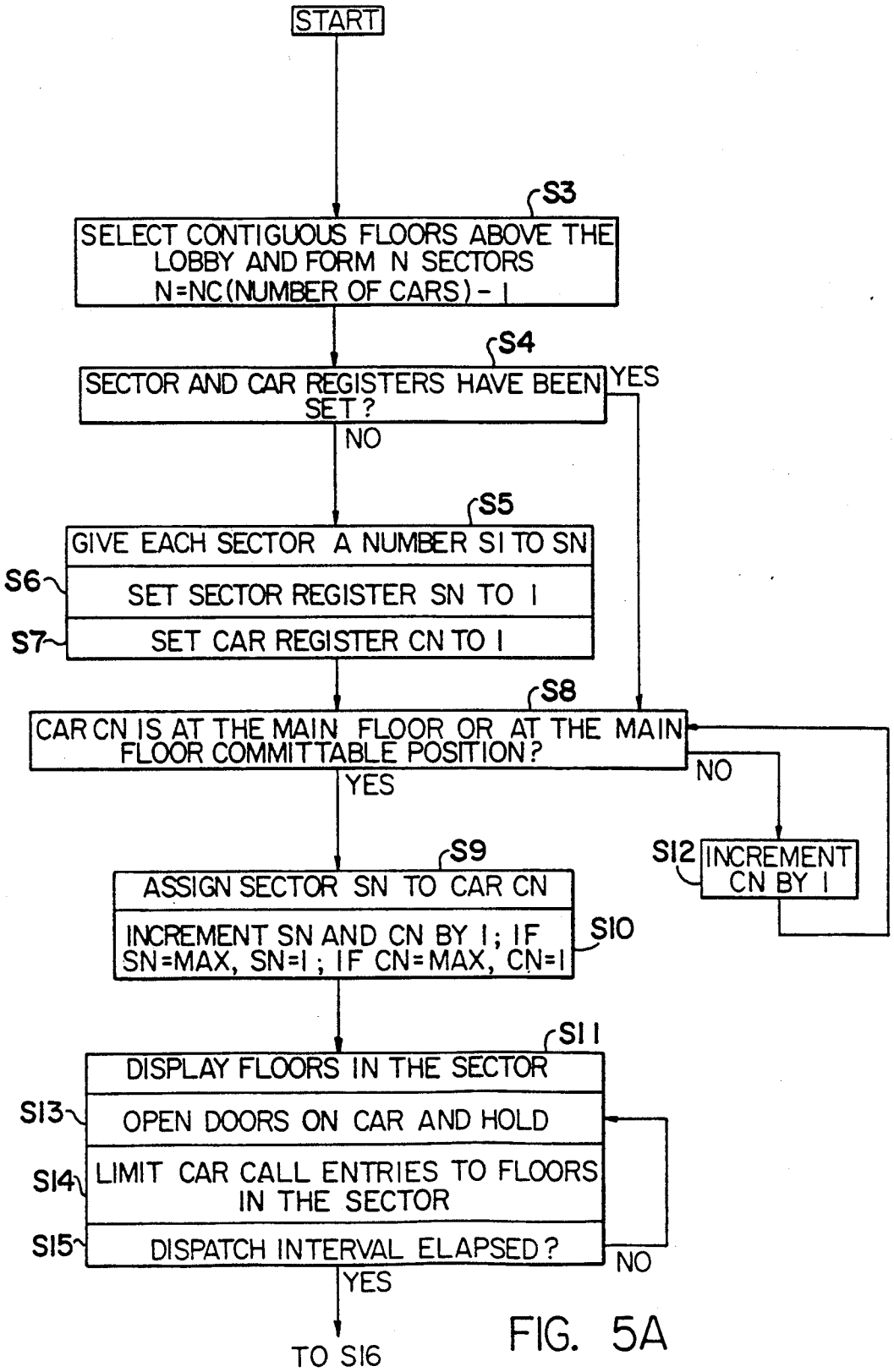
FIGS. 5A, 5B, 5C are logic diagrams for implementing a static sectoring routine.
Figure 5B:
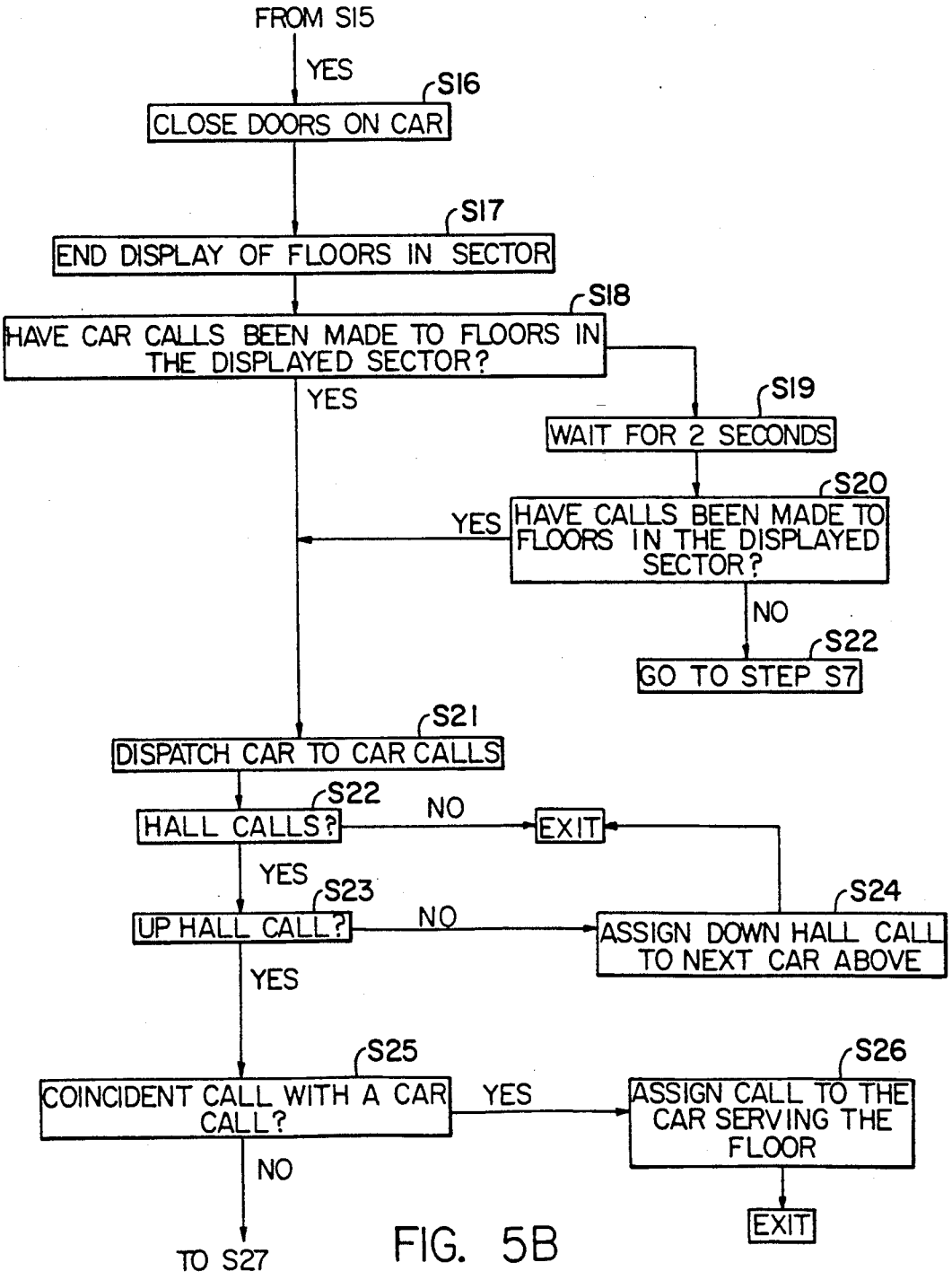

FIGS. 5A and 5B show a portion of the static sectoring algorithm. In step 3, the number of sectors "N" is equal to the number of cars (NC) minus 1. For instance, in FIG. 1, there are three sectors and four cars. Hall call assignment may be made according to the description below.

In FIG. 5A, in step 4, a test is made that determines that the up-peak channeling routine has been previously entered, which could have resulted in the performance of step 3, in which each sector is given a number and, in the performance of step 4 in which a sector register in the controller is set to 1, presumably the lowest SN and in the performance of step 5, in which a similar car register is set to the lowest car number (CN), presumably 1. For the purposes of illustration, in FIG. 1, the sector serving floors 2–5 has an SN of 1, the sector serving floors 6–9 has an SN of 2, and the sector serving floors 10–13 has an SN of 3. Car 1 would have a CN of 1, car 2 a CN of 2 , car 3 a CN of 3, and car 4 a CN of 4. CN and SN can be assumed to be initialized at 1. The sequence is illustrated by the flow chart's attempt to assign a sector to car 1, starting with sector 1.

In FIG. 5A, if the answer at step 4 is affirmative, step 8 is entered. Step 8 is also entered after the registers are initialized. In step 8, the test is whether the car with the number (CN) then under consideration, is at the committable position, a position at which the car is ready to initiate stopping at the lobby. If the answer to this test is negative (in FIG. 1 it would be negative because car 1 is moving away), CN is increased by one unit in step 12, meaning that the assignment attempt now shifts to car 2. For the purpose of illustration, assume that car 2 is descending at the indicated position. This will yield an affirmative answer at step 8, causing assignment of the sector 1 (containing floors 2–5) to car 2, that taking place in step 9. In step 10, both SN and CN are incremented by 1, but SN or CN have reached their respective maximums, something that would happen after each car in each sector is assigned. When that happens, SN and CN are set to 1 once again (on an individual basis in round-robin fashion). The sequence of operations assigns the sectors to the cars in a numerically cycling pattern.

In FIG. 5A, step 11, the floors and sectors assigned to a car in the previous sequence are displayed in the lobby or main floor on the "floor service indicator" (FSI). Step 13 commands the opening of the car doors when the car reaches the lobby and holds them in the open position to receive passengers, who presumably enter the car intending to enter car calls on the car call buttons (on the car operating panel) to go to the floors. Car calls are limited to those floors appearing on the service indicator, step 14. In step 15, it is determined if the dispatching interval has elapsed. If not, the routine cycles back to step 13, keeping the doors open. Once the dispatching interval passes (producing an affirmative answer at step 15), the doors are closed at step 16 (FIG. 5B). The floor service indicator is then deactivated at step 17 (until the next sector is assigned to the car). Step 18 determines if permissible car calls (car calls to floors in the sector) have been made. Since the sector is assigned to the car without regard to the entry of car calls, there is no demand for the sector at the particular time that the car is at the lobby ready to receive passengers (when the sector is assigned to the car at the main floor or lobby). Hence, if permissible car calls have not been made, the routine goes to step 19, where it waits for a short interval (for example, two seconds) and repeats the test of step 18 (at step 20). If the answer is still negative, the routine moves back to step 8 on the instruction at step 22. The routine then considers the assignment of the next numerical sector to the next numerical car at the committable position. Since a numerical sequence is followed, conflicts between cars at the committable position at the same time does not encumber the assignment process.

Figure 5C:
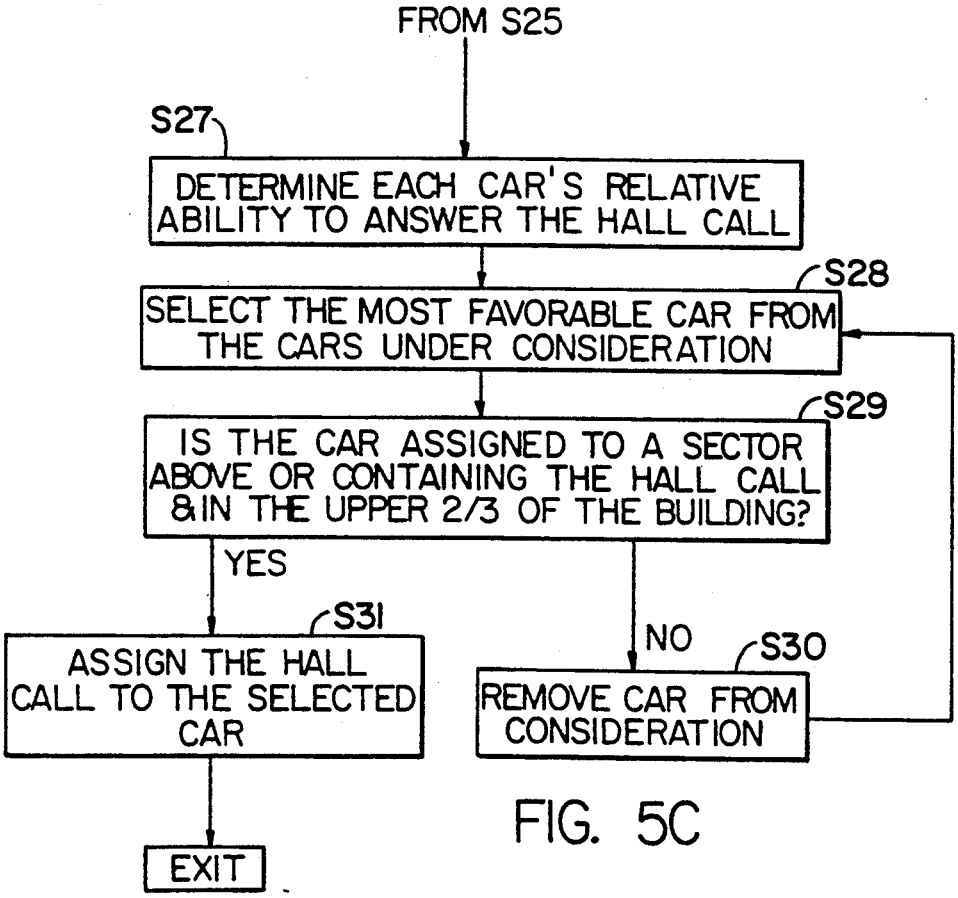

Following step 21, FIG. 5B, in which a car is dispatched to the car calls for the car to floors in the sector to which the car is assigned, the routine considers up and down hall calls (signals HC in FIG. 1), which are requests for service made at one of the floors. These requests give rise to interfloor traffic, which is usually light during the up-peak period. Consequently, assignment of hall calls is given a comparatively low priority when the up-peak static sectoring routine is in effect. Hall call assignments, at that time, are made in a way that brings cars back to the lobby as fast as possible for assignment to a sector, to minimize waiting time. In step 22, a simple test is made that finds if any hall calls have been made during the assignment cycle. If not, the routine is exited. If a hall call has been made on a floor, step 23 finds if it is a request to go down (down hall call) or up in the building. If it is a down hall call, in step 24, the hall call will be answered by the next available car traveling down from a location at or above the location of the hall call. Presumably, that assignment can be made according to the normal criteria, for instance, using the techniques described in the Bittar patent for selecting a car for hall call assignment on a comparative basis. If it is found that there is an up hall call, step 25 finds if there is a coincident car call in one of the cars at the lobby (assigned to a sector). If the answer is yes, the up hall call will be assigned to that car. If the answer in step 25 is no, step 27 (FIG. 5C) determines each car's ability to answer the up hall call under conditional criteria, preferably using sequences described in the previous patents to Bittar et al, by which a car is selected from all the other cars for final assignment by considering the impact of the assignment on the overall system response. At step 28, the sequence selects, using a normal selection routine, the most favorable car to answer the hall call and tests, at step 29, if the car is serving a sector in the upper two-thirds of the building, and if that sector is the sector that contains the floor in which the hall call, or is a higher sector (that is, above the sector containing the floor in which the hall call is placed). If the most favorable car cannot meet that test, using step 34, which increments the selection to the next most favorable car, the program cycles through from the most variable to the least variable until an affirmative is obtained to step 32, causing the assignment of the up hall call to the car meeting the test, this taking place in step 33.

Figure 6:
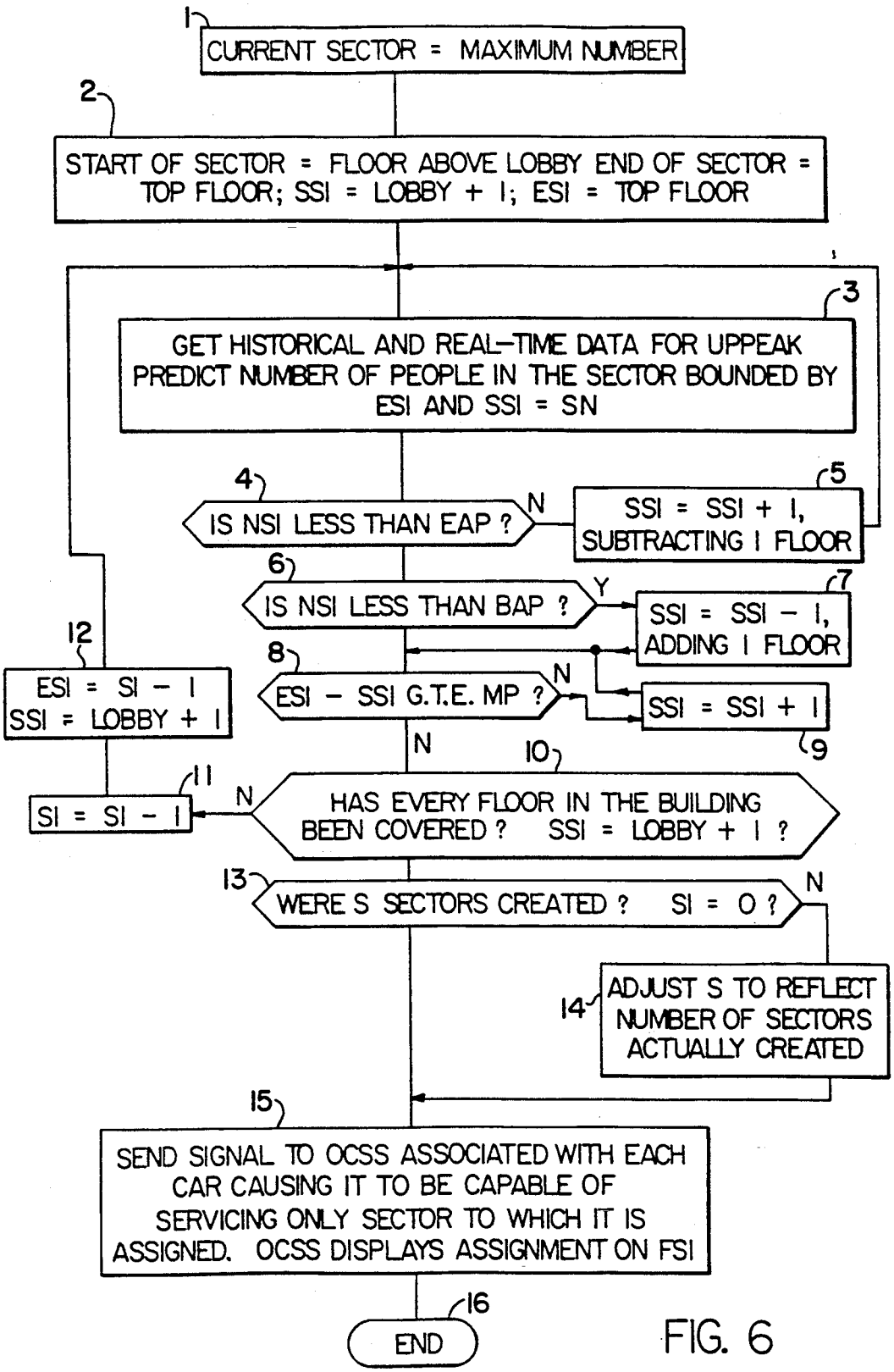
FIG. 6 is a logic diagram for implementing a dynamic sectoring routine.

FIG. 6 represents the dynamic sectoring algorithm. The creation of sectors begins at the top of the building. Step 1 works from the fact that the dispatching methodology used before implementation of the present methodology was static sectoring used after the up-peak clock turned on. Step 1 provides that in a system which recently used static sectoring, but now will use dynamic sectoring, the current sector under construction (SS1) has as its initial defining number the number of static sectors(s) used in the prior sectoring scheme. It is initially assumed by the present system that the number of dynamic sectors to be created may be as high as the number of static sectors which already exist. The first step, in effect, sets a counter. For example, if there were five static sectors, then the current sector under construction is the fifth sector. There will not be more dynamic sectors created than there were static sectors in the embodiment shown. The maximum limit on the number of dynamic sectors to be created need not be the number of static sectors used; the limit can be changed.

In FIG. 6, step 2 sets the size of the present sector under construction as equal to all of the floors in the building from the floor above the lobby to the top floor in the building. The end of the sector under construction (ES1) is the top floor of the building and the start of the sector under construction (SS1) is the floor above the lobby. Step 3 calculates the number of people predicted to be in the sector under construction (SN). This is done by using electrical signals to access a table of traffic data; the table, stored in a memory block associated with a signal processor, is arrived at by sensing the number of passengers boarding and deboarding over the past several minutes at the same time of day at some earlier time, for example, one or more days ago. The former sensings of boarding/deboarding are accumulated to form a real time prediction of the number of people predicted to be in the sector; the latter are accumulated for making an historic prediction of who will be in the sector. These two predictions, obtained on the basis of boarding/deboarding data, are combined to provide a still better measure of how many people may be in the sectors under construction. This measurement is the input into the routine of FIG. 6. The outputs will be signals to the OCSS to assign cars to serve certain floors of the building, and signals to a floor service indicator to display information telling which cars are assigned to which floors.

In FIG. 6, steps 4–7 work toward the same end: ensuring that the number of people in the sector is equal to a preset number, usually the number of people in the building divided by the number of sectors. The number of people in the building is estimated from information previously collected through load weighers or other means of collecting boarding/deboarding data. This information is also used to predict the destinations of passengers. Ideally, the number of people in each sector would be constant. The difference between BAP (beginning average persons per sector window) and EAP (end average persons per sector window) represents the variation from an average number of people in a sector (AP) which is acceptable. BAP represents the beginning of an acceptable window of variation from AP while EAP represents the end of the window. BAP may be, for example, 90% of AP, while EAP is 110% of AP. Step 4, then, determines if the number of people in the sector under construction, NS1, is less than EAP. If not, then we will want to subtract a floor from the sector, S1. This will reduce NS1. This is the purpose of Step 5. As SS1 is the nth floor at the bottom of the building, increasing it will make the start of the sector the nth plus 1 floor of the sector; the size of the sector will be correspondingly decreased by one.

Having created a sector which has a population less than EAP, the higher end of a population within acceptable limits of AP, we will want to determine if the sector population has fallen below the limit set by the lower end of the window, namely BAP. Determining whether that condition is true or false is achieved by step 6. If it is true then one floor will be reduced from the sector, in step 7, but if it is not true then the next step in the creation of the sector will be step 8.

In FIG. 6, having created a sector with the desired population, some number of people not above EAP nor below BAP, it is desired to modify the sector such that the number of floors in the sector does not exceed some predetermined number. Thus, step 8 determines if the number of floors in the sector, the difference between ES1 and SS1, exceeds MP, the maximum number of floors permitted in a sector. Step 9 subtracts a floor from the sector if there are too many floors in the sector. If there are not too many floors in the sector the method of the present invention proceeds to step 10 which determines if every floor in the building has been covered. If not, step 11 reduces by 1 the counter which keeps track of how many sectors have been created. Step 12 sets the size of the next sector as having in it all the floors in the building from the floor immediately below the bottom floor in the sector just created to the floor just above the lobby. If so, we must ask, in step 13, if the sector creation counter has been decremented to zero showing that the number of dynamic sectors created is the same as the number of static sectors which had been used. If no, in step 14 the system will reduce the number of sectors to be used to be the number of static sectors which had been used less the number of sectors left over and note the same in a table kept in the memory of ADSS (FIG. 2, 113); the table keeps track of how many sectors were created and what the definitions of these sectors are. If yes, in step 15 the sector creation has been completed. Therefore, in step 15: (a) signals are sent from the ADSS (FIG. 2, 113) to the OCSS (FIG. 2, 101) to dispatch the elevators according to the sector assignments just obtained; (b) the floor service indicator (FIG. 1) displays which cars are assigned to which sectors. In step 16, the process is terminated.

The process is then run through again some intervals later, during which time new boarding/deboarding information may necessitate restructuring the sectors; the value of S used in step 1 is that obtained in step 14 the first time the process was run through. The cycle will repeat itself as long as up-peak sectoring is used.

Although this invention has been shown and described with respect to detailed embodiments thereof, it will be understood by those skilled in the art that various changes in form and detail thereof may be made without departing from the spirit and scope of the claimed invention.

We claim:

1. A method of dispatching elevator cars, comprising the steps of:

retrieving a table of historical-time traffic data, which data consist of car load measurements and counts of the number of passengers who boarded cars at the lobby during an up-peak period and deboarded cars at floors other than the lobby, said counts and load measurements having taken place several days prior to said retrieving of said historical-time traffic data;

retrieving a table of real-time traffic data, which data consist of car load measurements and counts of the number of people who boarded cars at the lobby and deboarded cars at floors other than the lobby during an up-peak period, said counts and car load measurements having taken place several minutes prior to said retrieving of said real-time traffic data;

predicting, based on data collected from said steps of retrieving said historical-time and real-time traffic data, the number of people who will be arriving at the lobby at some future time and the floors to which those people will be taken by any car, car load, car capacity, and floor population;

selecting one dispatching method among a plurality of dispatching methods including an up-peak period, a static sectoring method, and a dynamic channeling method, in response to said step of predicting, said selection being a function of the average waiting time; and dispatching an elevator car in response to said step of selecting.

2. A method of claim 1 wherein said selection is a function of floor population.

3. A method of claim 1 wherein said selection is a function of car capacity filled.

* * * * *